United States Patent [19]

Knechtel

[11] 4,378,752

[45] Apr. 5, 1983

[54] FIXING APPARATUS

[75] Inventor: Wilhelm Knechtel, Biebertal, Fed. Rep. of Germany

[73] Assignee: Canon Kabushiki Kaisha, Tokyo, Japan

[21] Appl. No.: 320,703

[22] Filed: Nov. 12, 1981

Related U.S. Application Data

[63] Continuation of Ser. No. 893,434, Apr. 4, 1978, abandoned.

[30] Foreign Application Priority Data

Apr. 20, 1977 [DE] Fed. Rep. of Germany ..... 2717391

[51] Int. Cl.[3] ..... B05C 11/00; G03G 21/00

[52] U.S. Cl. ..... 118/60; 118/70; 118/260; 432/60

[58] Field of Search ..... 118/60, 260, 268, 104, 118/70; 432/60

[56] References Cited

U.S. PATENT DOCUMENTS

| | | | |
|---|---|---|---|
| 2,061,526 | 11/1936 | Storck | 118/260 X |
| 3,097,597 | 7/1963 | Visser | 101/364 |
| 3,268,351 | 8/1966 | Van Dorn | 430/99 |
| 3,831,553 | 8/1974 | Thettu | 118/266 |
| 3,883,291 | 5/1975 | Cloutier et al. | 432/60 |
| 3,924,564 | 12/1975 | Bar-on | 118/60 |

FOREIGN PATENT DOCUMENTS

| | | |
|---|---|---|
| 50-2940 | 1/1975 | Japan . |
| 50-116443 | 7/1975 | Japan . |

*Primary Examiner*—Evan K. Lawrence

*Attorney, Agent, or Firm*—Fitzpatrick, Cella, Harper & Scinto

[57] ABSTRACT

A fixing apparatus includes a roller for fixing a toner image formed on a supporting element, a container for receiving an offset preventing liquid and an element for applying the offset preventing liquid on the surface of the roller. The liquid applying element is partially immersed in the offset preventing liquid and it includes a liquid applying member for applying the liquid from the end surface of the member by capillary action, and a member adjacent the end surface to affect the capillary action by squeezing the liquid applying member to control the amount of the liquid applied . Felt is preferably used for the liquid applying member.

5 Claims, 1 Drawing Figure

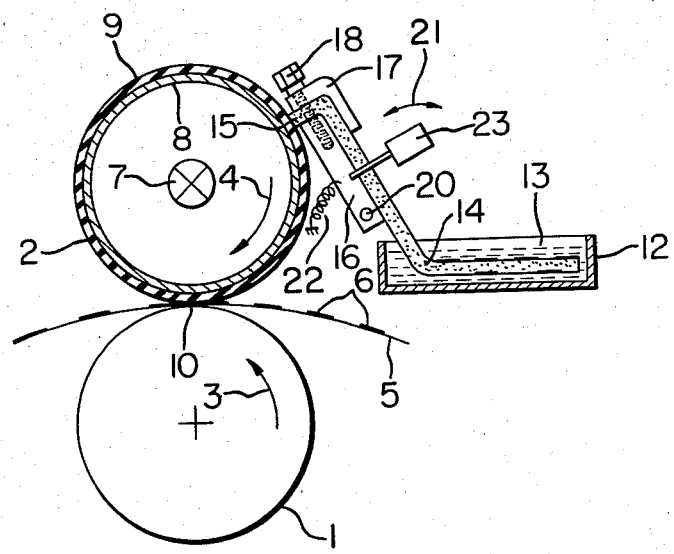
9
18
21
17
8
15
23
7
4
20
13
14
2
22
16
12
6
10
3
5
1

FIXING APPARATUS

This is a continuation of application Ser. No. 893,434, filed Apr. 4, 1978, now abandoned.

BACKGROUND OF THE INVENTION

1. Field of the Invention

This invention relates to a fixing apparatus used in electrophotography.

2. Description of the Prior Art

In electrophotography, an electrostatic latent image is formed on a photosensitive body having a photoconductive substance, the latent image is developed by a charged toner to visualize the image, the visualized image is transferred on a supporting member, and finally the toner is fixed on the supporting member by heating to obtain a copy. As a fixing system, in the case of using a dry powder developing agent, the supporting member bearing a visualized image is passed through a pair of mutually press-contacted rollers which constitutes a roller fixing apparatus. In general, the pair of rollers consist of a heating roller and a pressure roller, and each of the surfaces of these rollers is provided with a coated film of an offset preventing material such as for example silicone rubber or ethylene fluoride resin (Trade name Teflon) for preventing the offset of the toner image on the supporting member.

However, for improving the fixation, if the surface temperature of the roller is raised or if the offset preventing material on the roller surface is deteriorated, the toner image tends to offset on the heating roller and sometimes, the supporting member will be wound round the heating roller. For preventing this, it is usual to apply an offset preventing liquid such as silicone oil on the heating roller with the aid of, for example, felt or a roller. In the application of the offset preventing liquid, it is necessary to control the amount of the offset preventing liquid on the surface of the heating roller or the pressure roller to a suitable amount.

As a liquid applying material, it is usual to use a material such as heat resisting felt or fabric material having the property of absorbing and maintaining the offset preventing liquid utilizing the capillary action. However, in a system where the liquid applying material is always press contacted with the heating roller, the pressure roller or the liquid applying roller, it is quite difficult to suitably control the amount of liquid to be applied, and in many cases, an excess amount of the offset preventing liquid is applied. Especially, when the apparatus is not used for a long time, the liquid applying member has already absorbed the offset preventing liquid by the capillary action to the saturated state so that an excess amount of liquid is applied. As a result, the toner supporting member (a transfer paper) is contaminated by oil. Further, when the heating roller or pressure roller is formed by silicone series elastic material, if an excess amount of silicone series offset preventing liquid is applied, said roller will be swelled so that the diameter thereof becomes non-uniform. In a system where one of a pair of fixing rollers will rotate following the other roller by friction, the follower roller will slip and the rotating speed of the follower roller varies due to an excess amount of the liquid.

SUMMARY OF THE INVENTION

An object of this invention is to overcome said defects and provides a fixing apparatus enabling an improved fixing.

Another object of this invention is to provide a fixing apparatus which is able to control suitably the amount of the offset preventing liquid to be applied.

According to this invention, a member to offset the capillary action of the liquid applying member is provided to suitably control the amount of the offset preventing liquid.

BRIEF DESCRIPTION OF THE DRAWING

The Figure shows an embodiment of this invention.

DESCRIPTION OF THE PREFERRED EMBODIMENT

In the Figure, a copying paper 5 bearing a visible image of toner 6 passes between rollers 1 and 2 which are rotatable in the directions of the arrows 3 and 4, respectively.

The upper roller 2 comprises a hollow metallic roller 8 and a layer 9 surrounding the metallic roller 8. The layer 9 is made of silicone resin or ethylene fluoride resin. Inside of the roller 2, a heat source 7 of an infrared lamp is provided for heating the toner to melt it.

The lower roller 1 is of a metallic roller and both rollers 1 and 2 are press-contacted with each other along the surface 10 of about 4 mm width.

The toner on the copying paper 5 is melted and fixed on the paper 5 when it passes between two rollers 1 and 2.

For preventing the toner from adhering to the heating roller, there is provided a device to apply silicone oil 13 on the surface of the roller. The oil applying device comprises a vessel 12 containing silicone oil 13 and a oil applying member 14 for applying silicone oil to the surface of the roller 1. One end of the oil applying member 14 is immersed in silicone oil 13 and the surface of the other end 15 of the member 14 abuts on the roller 2 and has a width substantially equal to the width of the copying paper 5. The oil applying member 14 is made of a heat resisting felt or cloth and by the capillary action thereof it absorbes silicone oil to transmit silicone oil from one end to the other end. The upper portion of the oil applying member 14 is sandwiched between two wooden pieces 16 and 17 which are coupled removably by a screw 18 so that the distance between the two pieces adjacent the end surface 15 may be adjusted to control the amount of oil to be applied. The widths of two pieces 16 and 17 are larger than that of the member 14 and by screwing the screw 18 the distance between the two pieces is varied to squeeze the member 14 strongly or weakly adjacent the end surface 15 so as to affect the capillary action of the member 14 for varying the amount of oil to be applied. The amount of the oil is to be adjusted in such a manner that silicone film formed on the heating roller will remove the toner but does not contaminate the passing paper with oil.

Both wooden pieces are connected to spring 22 and plunger 23 and are able to rotate in the arrow direction 21 about a pivot 20. The plunger 23 is actuated depending on the appearance or disappearance of the paper 5, and when the paper is not transmitted between two rollers 1 and 2, the plunger 23 will move the member 14 to depart from the surface of the roller 2 and when the paper is transmitted between two rollers 1 and 2, the plunger 23 will move the member 14 to contact with the surface of the roller 2 to apply the oil thereon.

In the above embodiment, the oil is applied directly to the fixing roller by the member 14, but it is possible to provide an applying roller so as to firstly supply the oil to the applying roller by the member 14, and then apply the oil to the fixing roller by the oil applying roller.

The squeezing strength given to the member 14 is controlled once the distance between the two wooden pieces is adjusted but it can be controlled at will depending on the fixing state.

I claim:

1. A fixing apparatus comprising roller means for fixing a toner image formed on a supporting element, a vessel containing an offset preventing liquid, a member, having an end surface contactable with said roller means, for applying, by capillary action, the offset preventing liquid on the surface portion of said roller means which is utilized for the fixing action, means provided adjacent to said end surface of said liquid applying member for controlling the capillary action to thereby control the amount of liquid applied to said roller means by said liquid applying member, means for supporting said liquid applying member, and means for moving said support means toward and away from said roller means such that said end surface of said liquid applying member is movable into and out of contact with said roller means.

2. A fixing apparatus according to claim 1, wherein said controlling means comprises a holding member to sandwich said liquid applying member between said support means and said holding member and means for varying the distance between said holding member and said support means.

3. A fixing apparatus according to claim 2, wherein said distance varying means is a screw to couple said holding member and said support means.

4. A fixing apparatus according to claim 1, wherein said liquid applying member is made of felt.

5. A fixing apparatus according to claim 1, wherein said controlling means includes means to squeeze a portion adjacent said end surface of said liquid applying member.

* * * * *